US006133780A

United States Patent [19]

Chi

[11] Patent Number: 6,133,780

[45] Date of Patent: Oct. 17, 2000

[54] DIGITALLY TUNABLE VOLTAGE REFERENCE USING A NEURON MOSFET

[75] Inventor: Min-hwa Chi, Hsinchu, Taiwan

[73] Assignee: Taiwan Semiconductor Manufacturing Corporation, Hsinchu, Taiwan

[21] Appl. No.: 09/326,166

[22] Filed: Jun. 4, 1999

[51] Int. Cl.[7] ..... G05F 1/10; G05F 3/02

[52] U.S. Cl. ..... 327/541; 706/33

[58] Field of Search ..... 327/427, 434, 327/479, 540–543; 365/185.07, 185.26; 257/239, 314–316, 319, 320; 706/33, 15, 26

[56] References Cited

U.S. PATENT DOCUMENTS 5,706,403 1/1998 Shibata et al. ..... 395/23
5,721,702 2/1998 Briner ..... 365/185.21
5,748,534 5/1998 Dunlap et al. ..... 365/185.21
5,903,487 5/1999 Wu et al. ..... 365/45
6,031,397 2/2000 Banba ..... 327/81

*Primary Examiner*—My-Trang Nuton

*Attorney, Agent, or Firm*—Blakely, Sokoloff, Taylor & Zafman LLP

[57] ABSTRACT

A digitally tunable voltage reference circuit based on floating gate neuron MOSFETs and a $V_t$ referenced voltage source configuration is disclosed. The voltage reference can provide a wide range of voltage levels by biasing digital signals to the multiple inputs of the neuron MOSFET in the voltage source.

7 Claims, 2 Drawing Sheets

DIGITALLY TUNABLE VOLTAGE REFERENCE USING A NEURON MOSFET

FIELD OF THE INVENTION

The present invention relates to integrated circuit voltage references, and more particularly, to a voltage reference circuit using a neuron MOSFET.

BACKGROUND OF THE INVENTION

Voltage references are necessary in almost all integrated circuits. One well known circuit configuration of a voltage reference is shown in FIG. 1. See Gray and Meyer, "Analog VLSI Circuit Analysis", Chapter 12, Wiley (1984). In this circuit, the two n-MOS transistors M1 and M2 have the same size (i.e. same W/L) and are biased by current sources 103 having the same magnitude. The gate of M1 is grounded. An operational amplifier (op-amp) is connected to the source sides (for detecting the difference of $V_{t1}$ and $V_{t2}$) and the op-amp output is connected to the gate of M2 for maintaining the M2 transistor at turn-on. The $V_t$ (threshold voltage) of the two transistors is made different by either channel implant or by different doping type of the poly gate. The output $V_o$ from the op-amp is simply the difference of the $V_t$ of the two transistors, i.e. $V_{t1}-V_{t2}$. The accuracy of the circuit lies in the size matching of the transistors M1 and M2 and the offset of the op-amp. The basic circuit configuration in FIG. 1 can be modified with various additional circuits for trimming or calibration purposes, and the circuit is widely used in CMOS VLSI. The temperature coefficient of this circuit can be very good due to the cancellation of $V_t$ variations of the n-MOS transistors.

However, the circuit of FIG. 1 can provide only a single output voltage reference level that is set by the threshold voltages of the transistors. What is needed is a voltage reference circuit that is tunable over a wide range.

SUMMARY OF THE INVENTION

A voltage reference circuit is disclosed. The circuit comprises: a differential amplifier having a first input, a second input, and an output; a first MOSFET having a source, a drain, and a gate, said gate of said first MOSFET connected to said output of said amplifier, said drain of said first MOSFET connected to said first input of said amplifier, and said source of said first MOSFET connected to a voltage $V_{cc}$; and a neuron MOSFET having a source, a drain, and at least two inputs, said drain of said neuron MOSFET connected to said second input of said amplifier, and said source of said first MOSFET connected to said voltage $V_{cc}$.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 2:
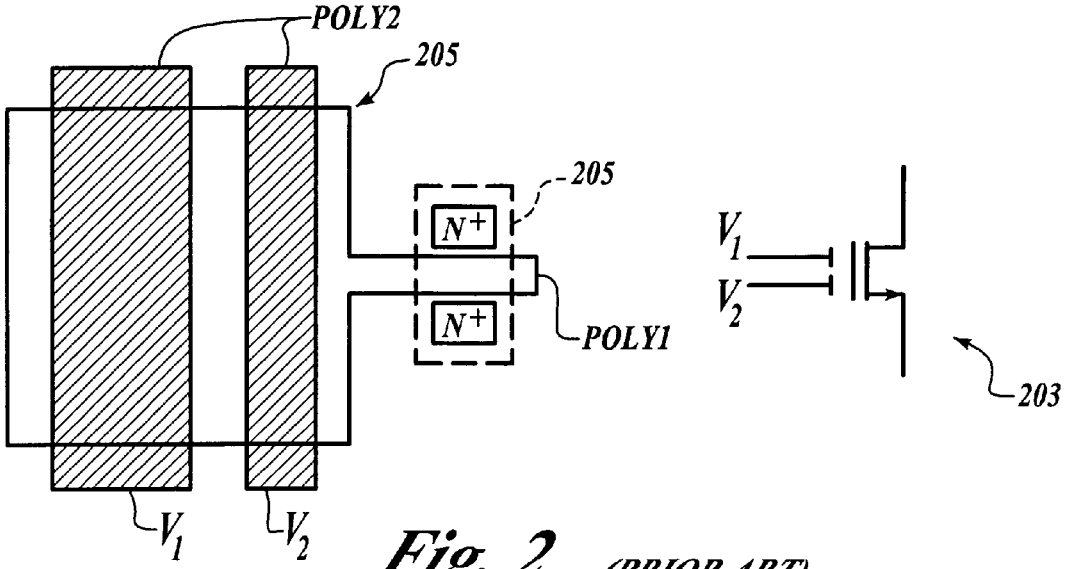
Fig. 2 (PRIOR ART)
FIG. 2 is a schematic diagram of a prior art neuron MOSFET.

The present invention provides a tunable voltage reference circuit that uses a floating-gate neuron MOS transistor. The floating-gate neuron transistor is simply a MOS transistor with gate coupling to a multiple input capacitor. See T. Shibata and T. Ohmi, "A Functional MOS Transistor Featuring Gate-Level Weighted Sum and Threshold Operations", IEEE Trans. Electron Devices, Vol. 39, No. 6, p. 1444–1455, 1992. FIG. 2 illustrates the layout and notation of a prior art two input n-channel neuron transistor 203. The gate coupling area 205 is designed to be much larger than the transistor channel area of the active area 201, so that the input gate coupling ratios (denoted as $r_1$ and $r_2$) are proportional to their coupling area and the sum of $r_1$ and $r_2$ is close to 1 (i.e. $r_1+r_2\cong 1$). A multiple-input (i.e. more than 2) neuron transistor can be similarly extended. The floating-gate potential $V_{fg}$ (poly1) of the neuron transistor is a weighted sum of their input bias, i.e. $V_{fg}=v_1r_1+v_2r_2$, where $v_1$ and $v_2$ are the input voltages and $r_1+r_21$.

When $V_{fg}$ is high enough (i.e. $>V_t$ of the n-MOS viewed from the floating gate), the MOS transistor is turned on and the neuron transistor is "fired". This floating-gate multiple input MOS transistor can simulate the operations of human neuron cells and is therefore referred to as a "neuron MOS transistor". The neuron MOS transistor is "smart" in the sense that it can naturally realize the operation of "weighted-sum then fire", which is relatively complicated if otherwise implemented by conventional static logic circuits. Both n-channel and p-channel MOS neuron transistors have useful applications since its invention in 1991. T. Shibata and T. Ohmi, "Neuron MOS Binary-Logic Integrated Circuits—Part 1: Design Fundamentals and Soft-Hardware-Logic Circuit Implementation", IEEE Trans. Electron Devices, Vol. 40, No. 3, p. 570–576, 1993 and T. Shibata and T. Ohmi, "Neuron MOS Binary-Logic Integrated Circuits—Part 2: Simplifying Technologies of Circuit Configuration and Their Practical Applications", IEEE Trans. Electron Devices, Vol. 40, No. 3, p. 974–979, 1993.

Figure 1:
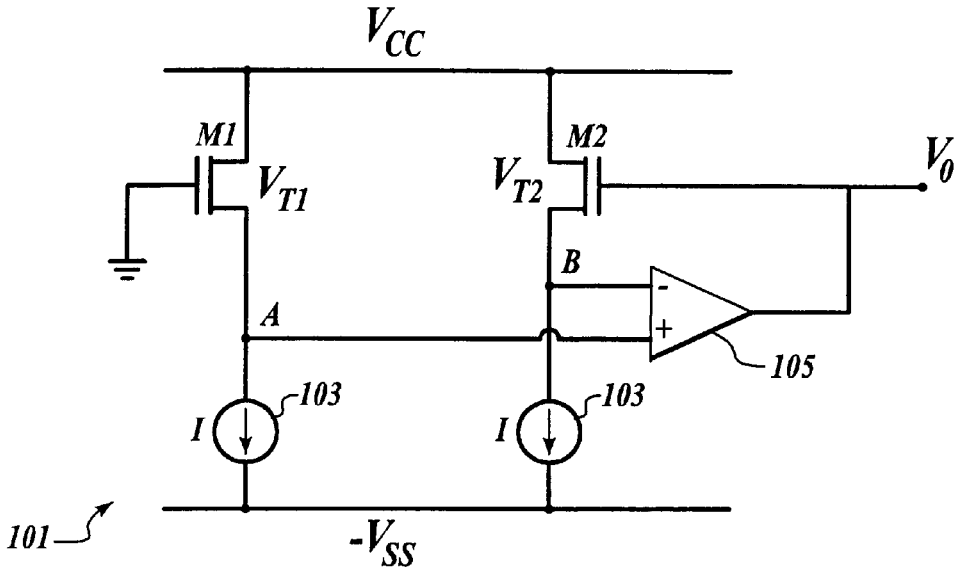
Fig. 1 (PRIOR ART)
FIG. 1 is a schematic diagram of a prior art voltage reference circuit.
Figure 3:
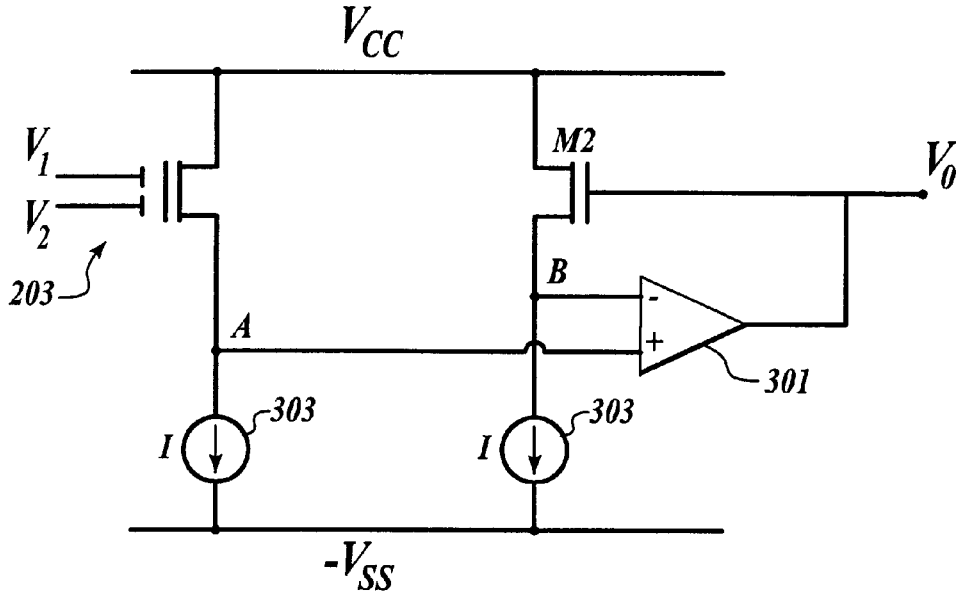
FIG. 3 is a schematic diagram of a two-input voltage reference circuit in accordance with the present invention.

The present invention uses a neuron MOS transistor in a voltage reference circuit as shown in FIG. 3. The circuit includes a 2-input neuron MOS transistor 203 replacing one of the n-MOS transistors (M1) in the prior art voltage reference circuit of FIG. 1. Importantly, the threshold voltages of the neuron MOS transistor (viewed from the floating gate) and the M2 transistor should be preferably and substantially equal at $V_t$. This is easily accomplished using conventional CMOS processes by matching the width and length of the active regions of the transistors.

The neuron transistor 203 and the M2 transistor are biased by current sources 303 having the same magnitude. An operational amplifier 301 is connected to the source sides and the op-amp output is connected to the gate of M2 for maintaining the M2 transistor at turn-on.

The output $V_o$ is simply $v_1r_1+v_2r_2$, where $v_1$ and $v_2$ are the two input biases, and $r_1$ and $r_2$ are the gate coupling ratios of the two input neuron transistor 203. The relationship $V_o=v_1r_1+v_2r_2$ can be derived as follows:

$$V_{fg}=v_1r_1+v_2r_2$$

(where $r_1$ and $r_2$ are between 0 and 1 and $r_1+r_2=1$)

$$V_A=V_{fg}-V_t=V_B$$

$$V_o=V_B+V_t$$

$$V_o=v_1r_1+v_2r_2$$

Therefore, by varying the input voltages of $v_1$ and $v_2$, $V_o$ can be easily tuned. Two examples of realization of multiple output voltage levels are seen in the tables below. Note that the input voltages $v_1$ and $v_2$ are assumed to be at $+V_{cc}$, ground, or $-V_{cc}$ levels.

| $r_1 = r_2 = 0.5$ | | |
|---|---|---|
| $v_1$ | $v_2$ | $v_o$ |
| $V_{cc}$ | $V_{cc}$ | $V_{cc}$ |
| $V_{cc}$ | 0 | $V_{cc}/2$ |
| 0 | $V_{cc}$ | $V_{cc}/2$ |
| 0 | 0 | 0 |
| $-V_{cc}$ | 0 | $-V_{cc}/2$ |
| 0 | $-V_{cc}$ | $-V_{cc}/2$ |
| $-V_{cc}$ | $-V_{cc}$ | $-V_{cc}$ |
| $r_1 = 2/3;\ r_2 = 1/3$ | | |
| $V_{cc}$ | $V_{cc}$ | $V_{cc}$ |
| $V_{cc}$ | 0 | $2V_{cc}/3$ |
| 0 | $V_{cc}$ | $V_{cc}/3$ |
| 0 | 0 | 0 |
| $-V_{cc}$ | 0 | $-2V_{cc}/3$ |
| 0 | $-V_{cc}$ | $-V_{cc}/3$ |
| $-V_{cc}$ | $-V_{cc}$ | $-V_{cc}$ |

In case 1, where $r_1$=r2=0.5, there are 5 output levels achievable, i.e. Vcc, Vcc/2, 0, −Vcc/2, and −Vcc. In case 2, where $r_1$=2/3, $r_2$=1/3, there are 7 output levels achievable, i.e. Vcc, 2Vcc/3, Vcc/3, 0, −Vcc/3, −2Vcc/3, and −Vcc. Notice that these levels can be dynamically tuned with their speed limited by the slew rate of the op-amp. The accuracy of the output voltage levels depends on several factors; e.g. the input voltage levels, coupling ratio accuracy, and op-amp offset. These factors can be improved by layout and known circuit techniques of trimming and calibration as in the prior art.

There are two main advantages of the reference circuit of the present invention over a conventional circuit. First, there can be multiple voltage levels available, and more importantly, these levels can be digitally tuned in a dynamic manner during circuit operation. Second, the fabrication of the circuit is based on double-poly CMOS technology. There is no need of fabricating transistors with different threshold voltages.

Figure 4:
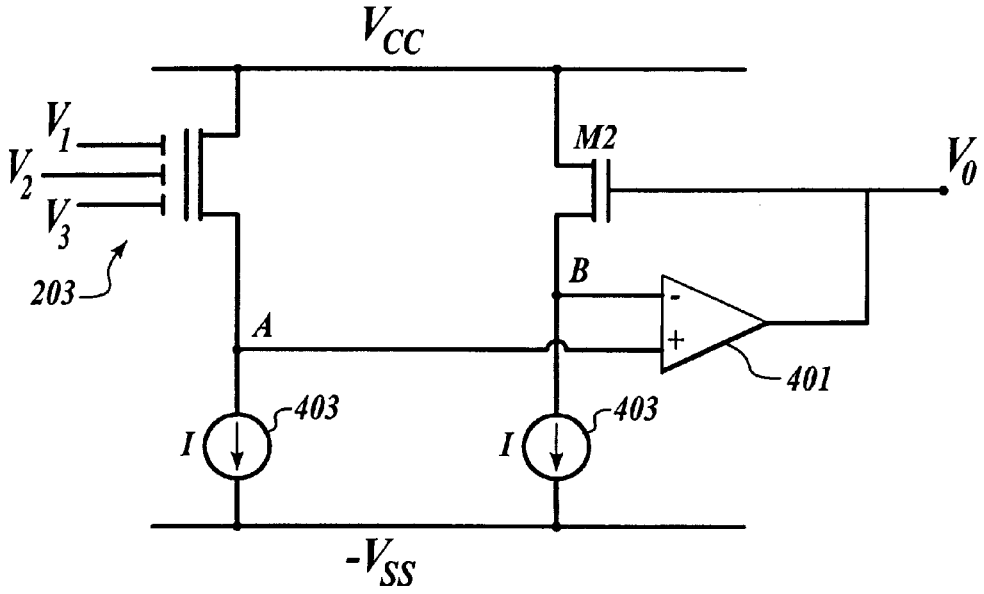
FIG. 4 is a schematic diagram of a three-input voltage reference circuit in accordance with the present invention.

The two input voltage reference circuit of FIG. 3 can be extended to a three input device to provide even more capabilities. The circuit is shown in FIG. 4. The circuit includes a 3-input neuron MOS transistor 203 replacing one of the n-MOS transistors (M1) in the prior art voltage reference circuit of FIG. 1.

The neuron transistor 203 and the M2 transistor are biased by current sources 403 having the same magnitude. An operational amplifier 401 is connected to the source sides and the op-amp output is connected to the gate of M2 for maintaining the M2 transistor at turn-on.

The output $V_o$ is derived as $v_1r_1+v_2r_2+v_3r_3$. As seen below:

$$V_{fg}=v_1r_1+v_2r_2+v_3r_3$$

(where $r_1$, $r_2$, and $r_3$ are between 0 and 1 and $r_1+r_2+r_3=1$)

$$V_A=V_{fg}-V_t=V_B$$

$$V_o=V_B+V_t$$

$$V_o=v_1r_1+v_2r_2+v_3r_3$$

If the 3rd input is used as a fine tuning control, then the output levels (digitally tuned by the 1st and 2nd input) can be shifted by the an amount $v_3r_3$. Further, the coupling ratio's of $r_1$ and $r_2$ can be made differently, so that the output levels can be non-uniformly spaced in a descending or ascending manner. One example is shown in the table below:

$r_1$=0.2; $r_2$=0.3; $r_3$=0.5

| $r_1 = 0.2;\ r_2 = 0.3;\ r_3 = 0.5$ | | | |
|---|---|---|---|
| $V_1$ | $V_2$ | $V_3$ | $V_o$ |
| $V_{cc}$ | $V_{cc}$ | $V_{cc}$ | $V_{cc}$ |
| 0 | $V_{cc}$ | $V_{cc}$ | $0.8V_{cc}$ |
| $V_{cc}$ | | $V_{cc}$ | $0.7V_{cc}$ |
| $V_{cc}$ | $V_{cc}$ | 0 | $0.5V_{cc}$ |
| 0 | 0 | $V_{cc}$ | $0.5V_{cc}$ |
| 0 | $V_{cc}$ | 0 | $0.3V_{cc}$ |
| $V_{cc}$ | 0 | 0 | $0.2V_{cc}$ |
| 0 | 0 | 0 | 0 |
| $-V_{cc}$ | 0 | 0 | $-0.2V_{cc}$ |
| 0 | $-V_{cc}$ | 0 | $-0.3V_{cc}$ |
| 0 | 0 | $-V_{cc}$ | $-0.5V_{cc}$ |
| $-V_{cc}$ | $-V_{cc}$ | 0 | $-0.5V_{cc}$ |
| $-V_{cc}$ | 0 | $-V_{cc}$ | $-0.7V_{cc}$ |
| 0 | $-V_{cc}$ | $-V_{cc}$ | $-0.8V_{cc}$ |
| $-V_{cc}$ | $-V_{cc}$ | $-V_{cc}$ | $-V_{cc}$ |

In principle, there can be many input nodes in the neuron MOS transistor included in the voltage reference circuit (at the cost of larger coupling area), so that to its limit, the output levels are close to analog output. Alternatively, if one of the inputs (e.g. $v_1$) is a continuously varied analog signal, then the output will be an analog signal a function of $v_1$ with its level shifted by the weighted sum of $v_2r_2+v_3r_3$. Therefore, the basic circuit configuration of FIGS. 3 and 4 can be used in various applications by designers.

While the preferred embodiment of the invention has been illustrated and described, it will be appreciated that various changes can be made therein without departing from the spirit and scope of the invention.

What is claimed:

1. A voltage reference circuit comprising:

a differential amplifier having a first input, a second input, and an output;

a first MOSFET having a source, a drain, and a gate, said gate of said first MOSFET connected to said output of said amplifier, said drain of said first MOSFET connected to said first input of said amplifier, and said source of said first MOSFET connected to a voltage $V_{cc}$; and a neuron MOSFET having a source, a drain, and at least two inputs, said drain of said neuron MOSFET connected to said second input of said amplifier, and said source of said first MOSFET connected to said voltage $V_{cc}$;

wherein said output provides a voltage reference.

2. The circuit of claim 1 further including two current sources connected to said drain of said first MOSFET and said drain of said neuron MOSFET, respectively, said two current sources drawing current at the same rate.

3. The circuit of claim 1 wherein said first input of said amplifier is an inverting input and said second input of said amplifier is a non-inverting input.

4. The circuit of claim 1 wherein said at least two inputs of said neuron MOSFET are selectively biased to $V_{cc}$ to provide said voltage reference.

5. The circuit of claim 1 wherein said neuron MOSFET has two inputs, each of said inputs having a gate coupling ratio of substantially 0.5.

6. The circuit of claim 1 wherein said neuron MOSFET has two inputs, a first input having a gate coupling ratio of about 1/3 and a second input having a gate coupling ratio of about 2/3.

7. The circuit of claim 1 wherein said neuron MOSFET has three inputs.

* * * * *